US009412230B2

(12) United States Patent
Acres

(10) Patent No.: US 9,412,230 B2
(45) Date of Patent: Aug. 9, 2016

(54) GAME PERFORMANCE DETERMINATION BY INCREMENTAL REVENUE

(71) Applicant: Patent Investment & Licensing Company, Las Vegas, NV (US)

(72) Inventor: John F. Acres, Las Vegas, NV (US)

(73) Assignee: PATENT INVESTMENT & LICENSING COMPANY, Las Vegas, NV (US)

( * ) Notice: Subject to any disclaimer, the term of this patent is extended or adjusted under 35 U.S.C. 154(b) by 0 days.

(21) Appl. No.: 14/085,543

(22) Filed: Nov. 20, 2013

(65) Prior Publication Data

US 2014/0080588 A1 Mar. 20, 2014

Related U.S. Application Data

(62) Division of application No. 12/553,875, filed on Sep. 3, 2009, now Pat. No. 8,616,977.

(51) Int. Cl.
*G07F 17/32* (2006.01)

(52) U.S. Cl.
CPC ..... *G07F 17/3234* (2013.01); *G07F 17/32* (2013.01)

(58) Field of Classification Search
USPC ..... 463/25
See application file for complete search history.

(56) References Cited

U.S. PATENT DOCUMENTS

| | | | | |
|---|---|---|---|---|
| 6,003,013 | A | 12/1999 | Boushy et al. | |
| 6,390,917 | B1 | 5/2002 | Walker et al. | |
| 6,508,710 | B1 | 1/2003 | Paravia et al. | |
| 6,517,435 | B2 * | 2/2003 | Soltys et al. | 463/25 |
| 6,645,068 | B1 | 11/2003 | Kelly et al. | |
| 7,384,338 | B2 | 6/2008 | Rothschild et al. | |
| 7,406,516 | B2 | 7/2008 | Davis et al. | |
| 7,730,198 | B2 * | 6/2010 | Ruppert et al. | 709/230 |

(Continued)

FOREIGN PATENT DOCUMENTS

| | | | |
|---|---|---|---|
| CA | 2 613 335 | A1 | 1/2007 |
| WO | 2004046859 | A2 | 6/2004 |

(Continued)

OTHER PUBLICATIONS

"Recent Trends for Casino Revenues, The Last Six Months: Nevada Gaming Statistics Aug. 2014 to Jan. 2015" published by University Libraries, University of Nevada, Las Vegas, accessible at URL <http://gaming.unlv.edu/reports/6_month_NV.pdf>, 3 pages.*

(Continued)

*Primary Examiner* — Jason Skaarup
(74) *Attorney, Agent, or Firm* — Marger Johnson

(57) ABSTRACT

Embodiments of the present invention are directed to methods of determining the performance of a gaming device by analyzing the incremental revenue generated by the gaming device. This method may include identifying an analysis period, recording game performance data for a set of gaming devices and a test gaming device during the analysis period, and comparing the recorded data to historical gaming data for the set of gaming devices. Some examples of this method may also include developing parameters for the analysis period and using those developed parameters to normalize the recorded game data for the analysis period prior to comparing the recorded data to the historical gaming data.

11 Claims, 9 Drawing Sheets

(56) References Cited

U.S. PATENT DOCUMENTS

| | | | | |
|---|---|---|---|---|
| 7,803,047 | B1 * | 9/2010 | Green | 463/29 |
| 7,937,464 | B2 * | 5/2011 | Ruppert et al. | 709/224 |
| 8,131,829 | B2 * | 3/2012 | Deng | 709/221 |
| 8,177,647 | B2 * | 5/2012 | Acres | 463/43 |
| 8,275,848 | B2 * | 9/2012 | Atashband et al. | 709/207 |
| 2002/0147049 | A1 | 10/2002 | Carter, Sr. | |
| 2004/0015423 | A1 * | 1/2004 | Walker et al. | 705/34 |
| 2004/0024666 | A1 * | 2/2004 | Walker et al. | 705/32 |
| 2004/0127277 | A1 * | 7/2004 | Walker et al. | 463/16 |
| 2004/0248642 | A1 | 12/2004 | Rothschild | |
| 2005/0148377 | A1 | 7/2005 | Goldberg et al. | |
| 2006/0217194 | A1 * | 9/2006 | Walker et al. | 463/29 |
| 2006/0229125 | A1 * | 10/2006 | Walker | G06Q 30/0218 463/20 |
| 2007/0060364 | A1 * | 3/2007 | Osgood et al. | 463/42 |
| 2007/0111799 | A1 * | 5/2007 | Robb et al. | 463/42 |
| 2008/0045317 | A1 | 2/2008 | Seelig et al. | |
| 2008/0102946 | A1 | 5/2008 | Amour | |
| 2008/0108433 | A1 | 5/2008 | DiMichele et al. | |
| 2008/0119283 | A1 | 5/2008 | Baerlocher | |
| 2008/0138773 | A1 * | 6/2008 | Lathrop | 434/72 |
| 2008/0153596 | A1 | 6/2008 | Nguyen | |
| 2008/0227551 | A1 | 9/2008 | Kelly et al. | |
| 2008/0261699 | A1 * | 10/2008 | Topham et al. | 463/42 |
| 2008/0263088 | A1 * | 10/2008 | Webster et al. | 707/103 R |
| 2009/0054139 | A1 * | 2/2009 | Anderson | 463/31 |
| 2009/0170608 | A1 * | 7/2009 | Herrmann et al. | 463/42 |
| 2010/0016073 | A1 * | 1/2010 | Goldstein et al. | 463/29 |
| 2010/0234097 | A1 * | 9/2010 | Gelber et al. | 463/25 |
| 2011/0081961 | A1 * | 4/2011 | Gagner et al. | 463/25 |
| 2011/0294566 | A1 * | 12/2011 | Cardno et al. | 463/25 |

FOREIGN PATENT DOCUMENTS

| | | | |
|---|---|---|---|
| WO | 2007014000 | A2 | 2/2007 |
| WO | WO 2007014000 | A2 * | 2/2007 |

OTHER PUBLICATIONS

Lucas, Anthony F. et al., Evaluating slot machine performance: A performance-potential model, 2004, pp. 103-121, vol. 23, Hospitality Management.

* cited by examiner

GAME PERFORMANCE DETERMINATION BY INCREMENTAL REVENUE

RELATED APPLICATION

This application claims priority and is a divisional application of U.S. Non-Provisional patent application Ser. No. 12/553,875, filed Sep. 3, 2009, entitled "GAME PERFORMANCE DETERMINATION BY INCREMENTAL REVENUE," which is incorporated by reference.

FIELD OF THE INVENTION

This disclosure relates generally to determining game performance data of gaming devices, and more particularly to determining game performance data of gaming devices using an analysis of the incremental revenue received with the gaming devices.

BACKGROUND

Casinos typically strive to have games that appeal to their customer base of players. One way to quantify customer enjoyment is by measuring the performance of each gaming device to ascertain which devices players prefer to play. From a slot manufacturing standpoint, game performance measurements or metrics enable these companies to design games that have features that are popular or preferred by players. These measurements have typically been limited to tracking the coin-in for electronic gaming devices and bets received for table games. Once these measurements have been collected for each gaming device, each gaming device is compared against a "house average" to determine if the gaming device has been popular with players.

For table games, these type of performance measurements usually only reveal broad trends such as differences in table denominations or differences in types of table games since the actual game from one similar table to another is largely identical. For electronic gaming devices, however, these performance numbers are often used to determine which games to buy, where to place certain games on the game floor, and how to configure certain game aspects.

One significant issue with simply comparing a games performance to the "house average" is that these numbers don't often accurately reflect the true value of a game. The house average is simply the total winnings of the house or casino for a group of gaming devices divided by the number of gaming devices. If a certain game often earns more than the house average, it is typically considered a successful game, while games that earn below the house average are generally regarded as less valuable. While comparisons to the house average may reflect how popular a game is relative to other games in the vicinity, it doesn't always reflect the games influence on overall casino revenue. For example, if Game A does three times the house average over the span of a week, but draws players from other games in the casino while Game B does only half of the house average but brings in entirely new players, which game is really more valuable to the casino? Obviously Game A is popular, but it doesn't help the overall casino revenue. On the other hand, Game B, although not as popular as Game A, is bringing in entirely new players and additional revenue from those new players. Thus, what is needed is a way to capture a games value to the casino instead of merely judging its relative popularity.

DETAILED DESCRIPTION

Figure 1A:
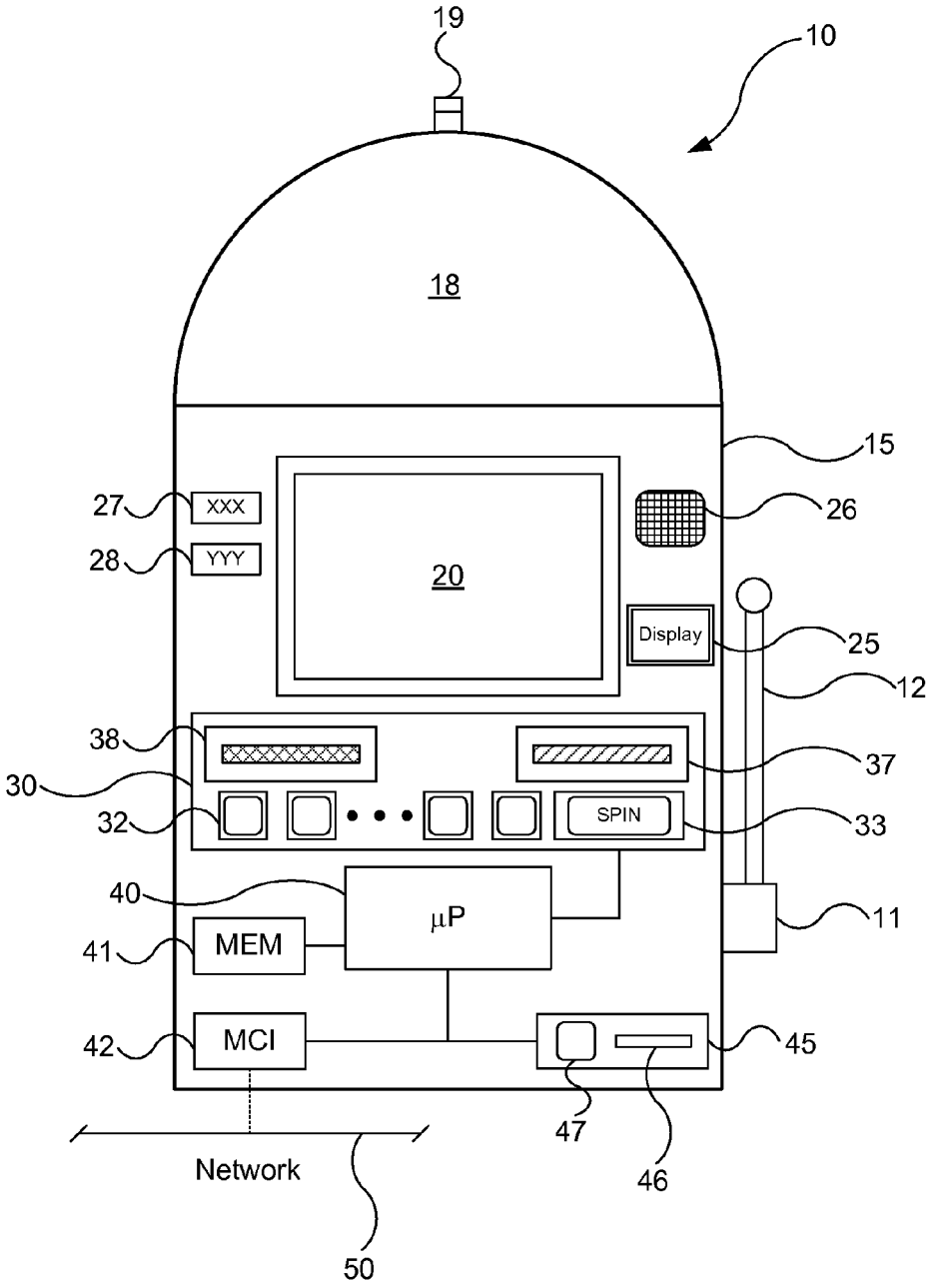
FIG. 1A is a functional block diagram that illustrates a gaming device according to embodiments of the invention.
Figure 1B:
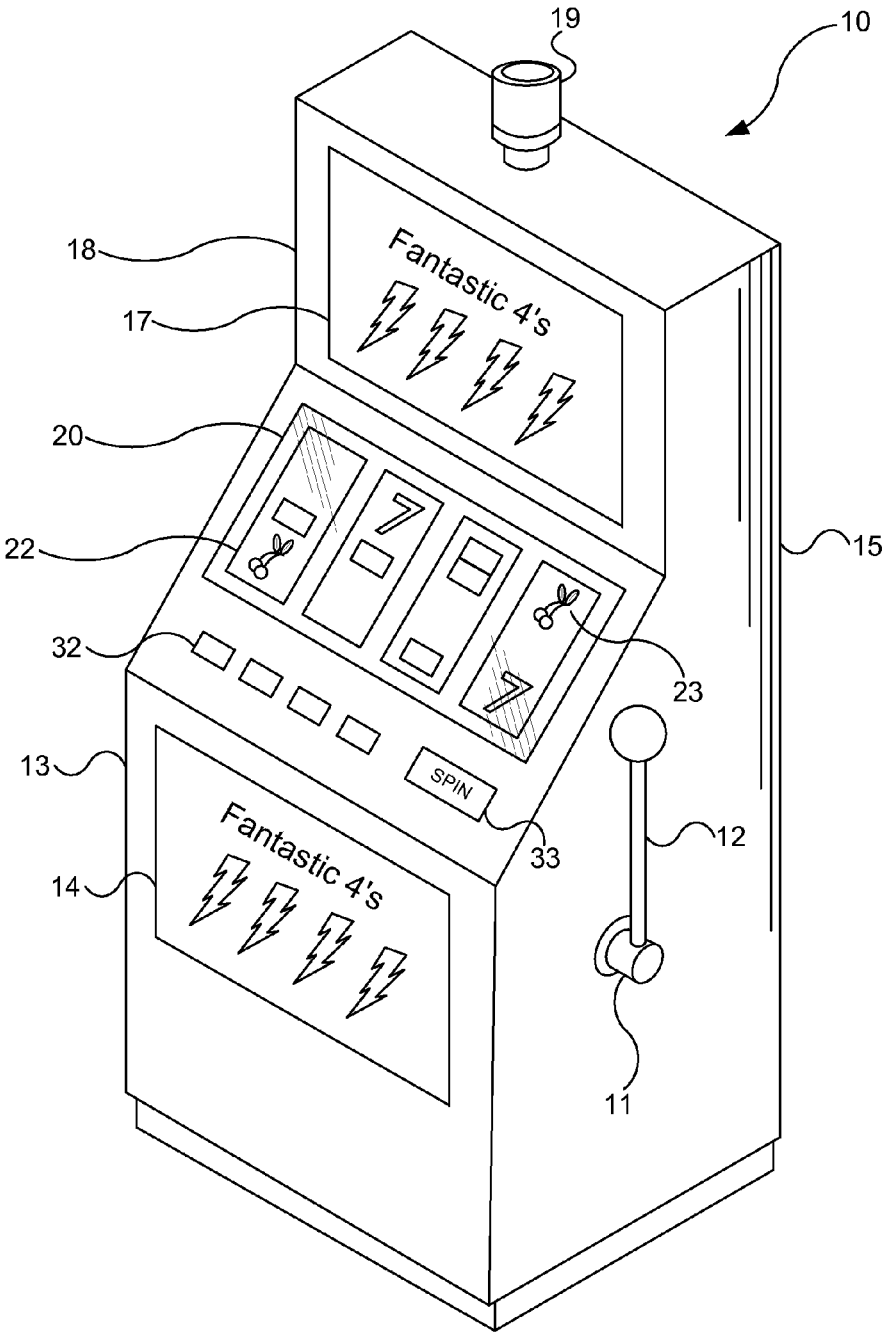
FIG. 1B is an isometric view of the gaming device illustrated in FIG. 1A.

FIGS. 1A and 1B illustrate example gaming devices according to embodiments of the invention.

Referring to FIGS. 1A and 1B, a gaming device 10 is an electronic gaming machine. Although an electronic gaming machine or "slot" machine is illustrated, various other types of devices may be used to wager monetarily based credits on a game of chance in accordance with principles of the invention. The term "electronic gaming device" is meant to include various devices such as electro-mechanical spinning-reel type slot machines, video slot machines, and video poker machines, for instance. Other gaming devices may include computer-based gaming machines, wireless gaming devices, multi-player gaming stations, modified personal electronic gaming devices (such as cell phones), personal computers, server-based gaming terminals, and other similar devices. Although embodiments of the invention will work with all of the gaming types mentioned, for ease of illustration the present embodiments will be described in reference to the electronic gaming machine 10 shown in FIGS. 1A and 1B.

The gaming device 10 includes a cabinet 15 housing components to operate the gaming device 10. The cabinet 15 may include a gaming display 20, a base portion 13, a top box 18, and a player interface panel 30. The gaming display 20 may include mechanical spinning reels (FIG. 2A), a video display (FIGS. 2B and 2C), or a combination of both spinning reels and a video display (not shown). The gaming cabinet 15 may also include a credit meter 27 and a coin-in or bet meter 28. The credit meter 27 may indicate the total number of credits remaining on the gaming device 10 that are eligible to be wagered. In some embodiments, the credit meter 27 may reflect a monetary unit, such as dollars. However, it is often preferable to have the credit meter 27 reflect a number of 'credits,' rather than a monetary unit. The bet meter 28 may indicate the amount of credits to be wagered on a particular game. Thus, for each game, the player transfers the amount that he or she wants to wager from the credit meter 27 to the bet meter 28. In some embodiments, various other meters may be present, such as meters reflecting amounts won, amounts paid, or the like. In embodiments where the gaming display 20 is a video monitor, the information indicated on the credit meters may be shown on the gaming display itself 20 (FIG. 2B).

The base portion 13 may include a lighted panel 14, a coin return (not shown), and a gaming handle 12 operable on a partially rotating pivot joint 11. The game handle 12 is traditionally included on mechanical spinning-reel games, where the handle may be pulled toward a player to initiate the spinning of reels 22 after placement of a wager. The top box 18 may include a lighted panel 17, a video display (such as an LCD monitor), a mechanical bonus device (not shown), and a candle light indicator 19. The player interface panel 30 may include various devices so that a player can interact with the gaming device 10.

The player interface panel 30 may include one or more game buttons 32 that can be actuated by the player to cause the gaming device 10 to perform a specific action. For example, some of the game buttons 32 may cause the gaming device 10 to bet a credit to be wagered during the next game, change the number of lines being played on a multi-line game, cash out the credits remaining on the gaming device (as indicated on the credit meter 27), or request assistance from casino personnel, such as by lighting the candle 19. In addition, the player interface panel 30 may include one or more game actuating buttons 33. The game actuating buttons 33 may initiate a game with a pre-specified amount of credits. On some gaming devices 10 a "Max Bet" game actuating button 33 may be included that places the maximum credit wager on a game and initiates the game. The player interface panel 30 may further include a bill acceptor 37 and a ticket printer 38. The bill acceptor 37 may accept and validate paper money or previously printed tickets with a credit balance. The ticket printer 38 may print out tickets reflecting the balance of the credits that remain on the gaming device 10 when a player cashes out by pressing one of the game buttons 32 programmed to cause a 'cashout.' These tickets may be inserted into other gaming machines or redeemed at a cashier station or kiosk for cash.

The gaming device 10 may also include one or more speakers 26 to transmit auditory information or sounds to the player. The auditory information may include specific sounds associated with particular events that occur during game play on the gaming device 10. For example, a particularly festive sound may be played during a large win or when a bonus is triggered. The speakers 26 may also transmit "attract" sounds to entice nearby players when the game is not currently being played.

The gaming device 10 may further include a secondary display 25. This secondary display 25 may be a vacuum fluorescent display (VFD), a liquid crystal display (LCD), a cathode ray tube (CRT), a plasma screen, or the like. The secondary display 25 may show any combination of primary game information and ancillary information to the player. For example, the secondary display 25 may show player tracking information, secondary bonus information, advertisements, or player selectable game options.

The gaming device 10 may include a separate information window (not shown) dedicated to supplying any combination of information related to primary game play, secondary bonus information, player tracking information, secondary bonus information, advertisements or player selectable game options. This window may be fixed in size and location or may have its size and location vary temporally as communication needs change. One example of such a resizable window is International Game Technology's "service window". Another example is Las Vegas Gaming Incorporated's retrofit technology which allows information to be placed over areas of the game or the secondary display screen at various times and in various situations.

The gaming device 10 includes a microprocessor 40 that controls operation of the gaming device 10. If the gaming device 10 is a standalone gaming device, the microprocessor 40 may control virtually all of the operations of the gaming devices and attached equipment, such as operating game logic stored in memory (not shown) as firmware, controlling the display 20 to represent the outcome of a game, communicating with the other peripheral devices (such as the bill acceptor 37), and orchestrating the lighting and sound emanating from the gaming device 10. In other embodiments where the gaming device 10 is coupled to a network 50, as described below, the microprocessor 40 may have different tasks depending on the setup and function of the gaming device. For example, the microprocessor 40 may be responsible for running the base game of the gaming device and executing instructions received over the network 50 from a bonus server or player tracking server. In a server-based gaming setup, the microprocessor 40 may act as a terminal to execute instructions from a remote server that is running game play on the gaming device.

The microprocessor 40 may be coupled to a machine communication interface (MCI) 42 that connects the gaming device 10 to a gaming network 50. The MCI 42 may be coupled to the microprocessor 40 through a serial connection, a parallel connection, an optical connection, or in some cases a wireless connection. The gaming device 10 may include memory 41 (MEM), such as a random access memory (RAM), coupled to the microprocessor 40 and which can be used to store gaming information, such as storing total coin-in statistics about a present or past gaming session, which can be communicated to a remote server or database through the MCI 42. The MCI 42 may also facilitate communication between the network 50 and the secondary display 25 or a player tracking unit 45 housed in the gaming cabinet 15.

The player tracking unit 45 may include an identification device 46 and one or more buttons 47 associated with the player tracking unit 45. The identification device 46 serves to identify a player, by, for example, reading a player-tracking device, such as a player tracking card that is issued by the casino to individual players who choose to have such a card. The identification device 46 may instead, or additionally, identify players through other methods. Player tracking systems using player tracking cards and card readers 46 are known in the art. Briefly summarizing such a system, a player registers with the casino prior to commencing gaming. The casino issues a unique player-tracking card to the player and opens a corresponding player account that is stored on a server or host computer, described below with reference to FIG. 3. The player account may include the player's name and mailing address and other information of interest to the casino in connection with marketing efforts. Prior to playing one of the gaming devices in the casino, the player inserts the player tracking card into the identification device 46 thus permitting the casino to track player activity, such as amounts wagered, credits won, and rate of play.

To induce the player to use the card and be an identified player, the casino may award each player points proportional to the money or credits wagered by the player. Players typically accrue points at a rate related to the amount wagered, although other factors may cause the casino to award the player various amounts. The points may be displayed on the secondary display 25 or using other methods. In conventional player tracking systems, the player may take his or her card to a special desk in the casino where a casino employee scans the card to determine how many accrued points are in the player's account. The player may redeem points for selected merchandise, meals in casino restaurants, or the like, which each have assigned point values. In some player tracking systems, the player may use the secondary display 25 to access their player tracking account, such as to check a total number of points, redeem points for various services, make changes to their account, or download promotional credits to the gaming device 10. In other embodiments, the identification device 46 may read other identifying cards (such as driver licenses, credit cards, etc.) to identify a player and match them to a corresponding player tracking account. Although FIG. 1A shows the player tracking unit 45 with a card reader as the identification device 46, other embodiments may include a player tracking unit 45 with a biometric scanner, PIN code acceptor, or other methods of identifying a player to pair the player with their player tracking account.

A player typically plays the gaming device 10 by placing a wager and activating an input mechanism to initiate a game associated with the placed wager. As used herein, a gaming event refers to any activity that affects the calculation or display of a game outcome. Game events include interactions occurring between the gaming device 10, the player, and/or a connected game system. Example gaming events include a player inserting a player account card in a gaming device, a double-pay bonus time period activation, a first spinning reel coming to a stop, a player's input to hold a card in a poker hand, etc. A game refers to the calculation and completion of one game outcome. That is, a game includes a single game cycle that begins with the initiation of the wagered upon game and ends with the completion of all activities relating to the wager placed including any intervening bonuses. In other words, a game encompasses all gaming events dependent on a placed wager during an initiated game including all amounts due the player that are paid directly by the gaming machine, or as a manual payment by casino personnel to the player playing that gaming machine. For example, if an item was awarded as a result of a wager that could be saved and used later, the game would encompass the awarding of the item, which is part of the game outcome, but not the later use of that item since the later use would affect a different game outcome. A game session refers to one or more played games. For example, a game session for a particular player may include each game played on a specific gaming device, each game played between insertions of money or credits, each game played between an initial money or credit insertion and a cash-out or zeroing out of credits, each game played during a casino stay, or each game played over a predetermined time period. Alternatively, game sessions may refer to games played by multiple players over a specified time period or event period with respect to a particular gaming device or group of gaming devices.

The player may initially insert monetary bills or previously printed tickets with a credit value into the bill acceptor 37. The player may also put coins into a coin acceptor (not shown) or a credit, debit or casino account card into a card reader/authorizer (not shown). In other embodiments, stored player points or special 'bonus points' awarded to the player or accumulated and/or stored in a player account may be able to be substituted at or transferred to the gaming device 10 for credits or other value. For example, a player may convert stored loyalty points to credits or transfer funds from his bank account, credit card, casino account or other source of funding. The selected source of funding may be selected by the player at time of transfer, determined by the casino at the time of transfer or occur automatically according to a predefined selection process. One of skill in the art will readily see that this invention is useful with all gambling devices, regardless of the manner in which wager value-input is accomplished.

The credit meter 27 displays the numeric credit value of the money or other value inserted, transferred, or stored dependent on the denomination of the gaming device 10. That is, if the gaming device 10 is a nickel slot machine and a $20 bill inserted into the bill acceptor 37, the credit meter will reflect 400 credits or one credit for each nickel of the inserted twenty dollars. For gaming devices 10 that support multiple denominations, the credit meter 27 will reflect the amount of credits relative to the denomination selected. Thus, in the above example, if a penny denomination is selected after the $20 is inserted the credit meter will change from 400 credits to 2000 credits.

A wager may be placed by pushing one or more of the game buttons 32, which may be reflected on the bet meter 28. That is, the player can generally depress a "bet one" button (one of the buttons on the player interface panel 30, such as 32), which transfers one credit from the credit meter 27 to the bet meter 28. Each time the button 32 is depressed an additional single credit transfers to the bet meter 28 up to a maximum bet that can be placed on a single play of the electronic gaming device 10. The game may be initiated by pulling the gaming handle 12 or depressing the spin button 33. On some gaming devices 10, a "max bet" button (another one of the buttons 32 on the player interface panel 30) may be depressed to wager the maximum number of credits supported by the gaming device 10 and initiate a game.

If the game does not result in any winning combination, the process of placing a wager may be repeated by the player. Alternatively, the player may cash out any remaining credits on the credit meter 27 by depressing the "cash-out" button (another button 32 on the player interface panel 30), which causes the credits on the credit meter 27 to be paid out in the form of a ticket through the ticket printer 38, or may be paid out in the form of returning coins from a coin hopper (not shown) to a coin return tray.

If instead a winning combination (win) appears on the display 20, the award corresponding to the winning combination is immediately applied to the credit meter 27. For example, if the gaming device 10 is a slot machine, a winning combination of symbols 23 may land on a played payline on reels 22. If any bonus games are initiated, the gaming device 10 may enter into a bonus mode or simply award the player with a bonus amount of credits that are applied to the credit meter 27.

Figure 2A:
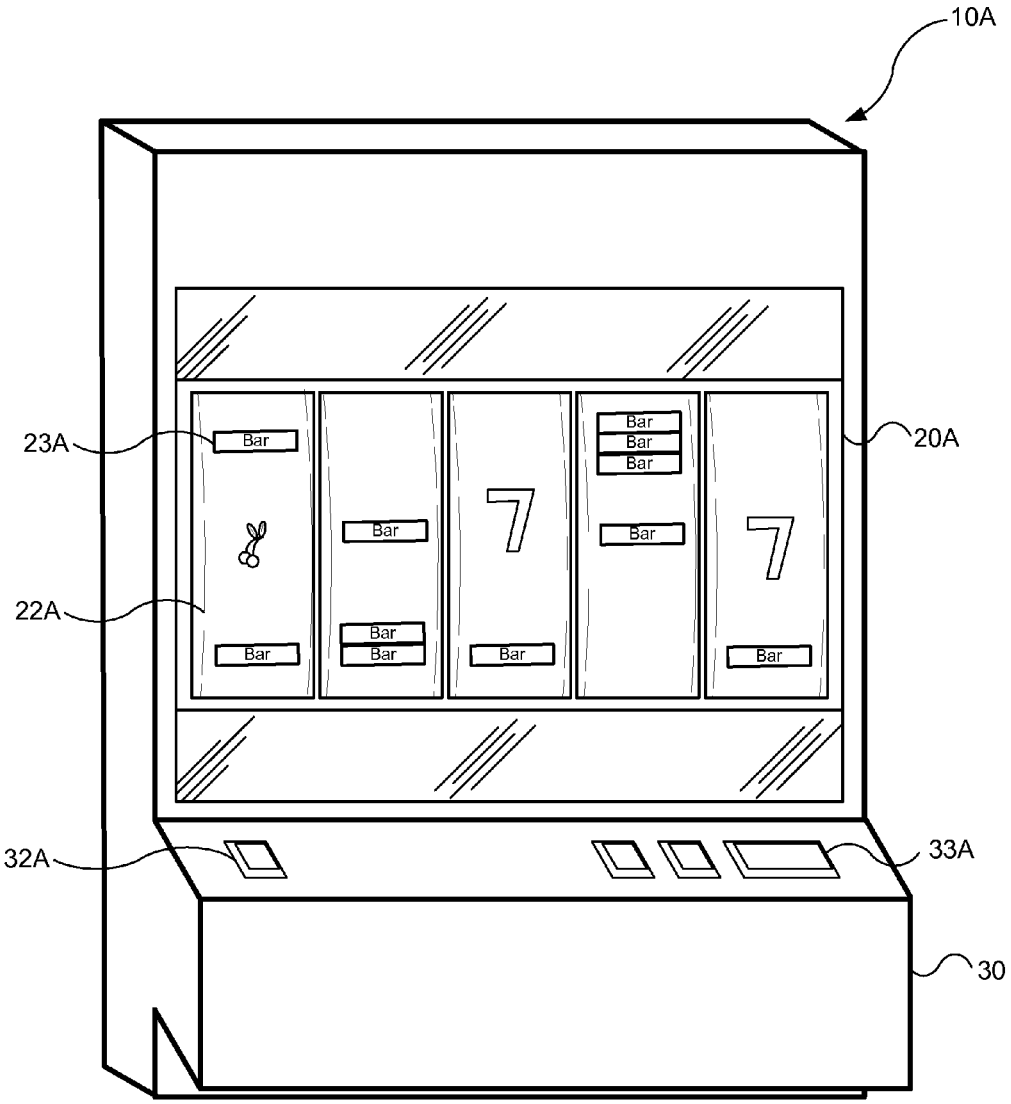
FIGS. 2A, 2B, and 2C are detail diagrams of exemplary types of gaming devices according to embodiments of the invention.
Figure 2B:
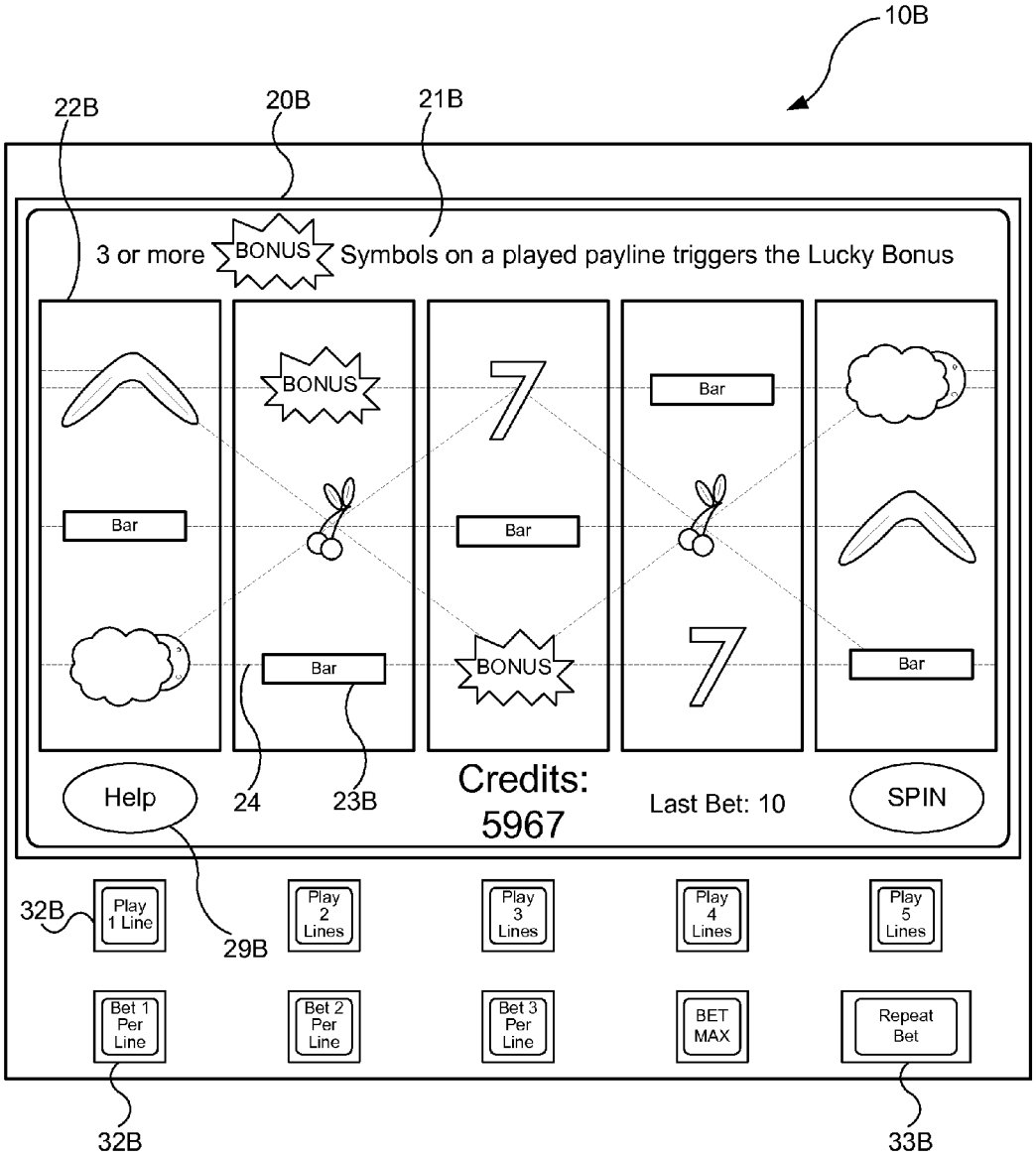
Figure 2C:
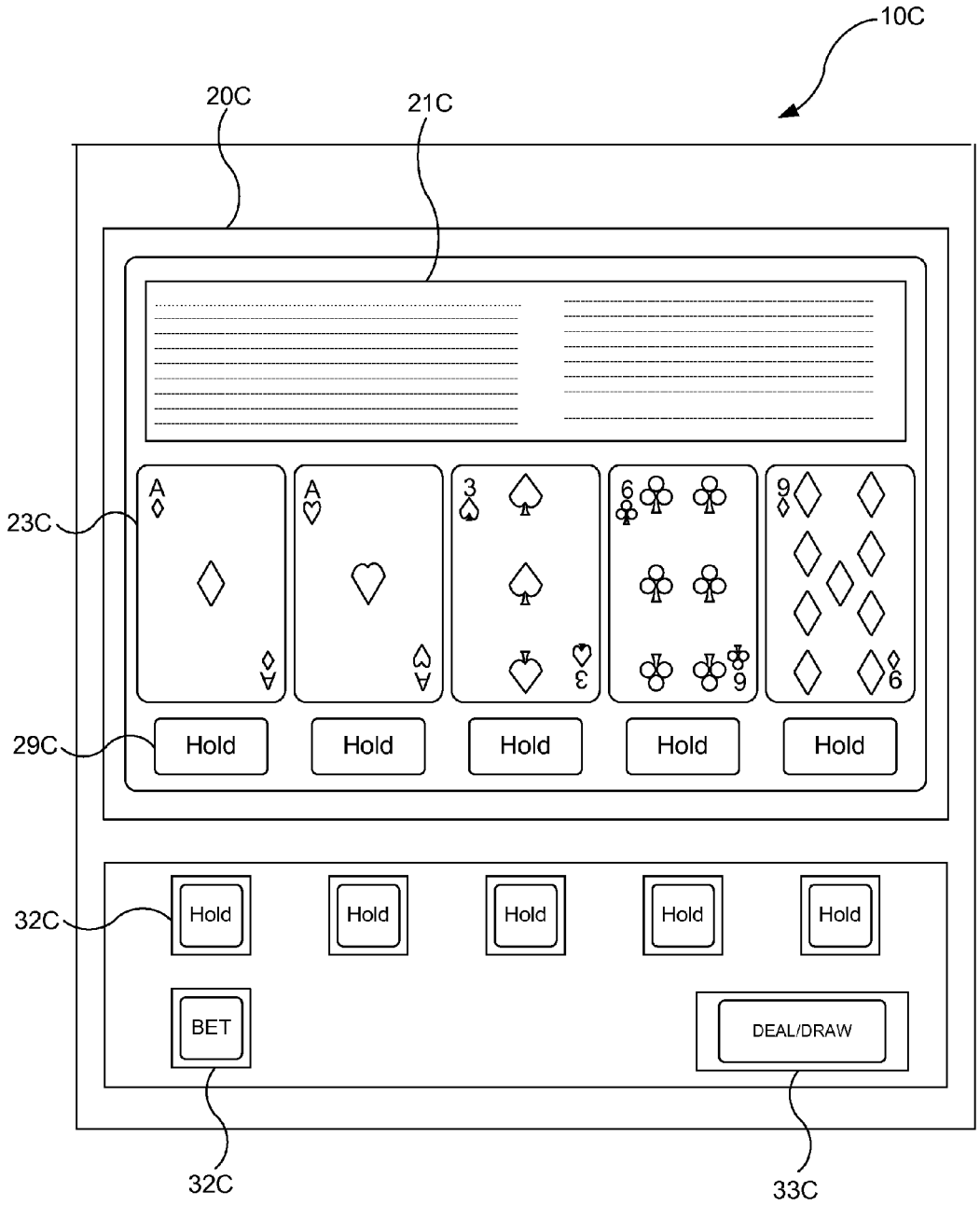

FIGS. 2A to 2C illustrate exemplary types of gaming devices according to embodiments of the invention. FIG. 2A illustrates an example spinning-reel gaming machine 10A, FIG. 2B illustrates an example video slot machine 10B, and FIG. 2C illustrates an example video poker machine 10C.

Referring to FIG. 2A, a spinning-reel gaming machine 10A includes a gaming display 20A having a plurality of mechanical spinning reels 22A. Typically, spinning-reel gaming machines 10A have three to five spinning reels 22A. Each of the spinning reels 22A has multiple symbols 23A that may be separated by blank areas on the spinning reels 22A, although the presence of blank areas typically depends on the number of reels 22A present in the gaming device 10A and the number of different symbols 23A that may appear on the spinning reels 22A. Each of the symbols 22A or blank areas makes up a "stop" on the spinning reel 22A where the reel 22A comes to rest after a spin. Although the spinning reels 22A of various games 10A may have various numbers of stops, many conventional spinning-reel gaming devices 10A have reels 22A with twenty two stops.

During game play, the spinning reels 22A may be controlled by stepper motors (not shown) under the direction of the microprocessor 40 (FIG. 1A). Thus, although the spinning-reel gaming device 10A has mechanical based spinning reels 22A, the movement of the reels themselves is electronically controlled to spin and stop. This electronic control is advantageous because it allows a virtual reel strip to be stored in the memory 41 of the gaming device 10A, where various "virtual stops" are mapped to each physical stop on the physical reel 22A. This mapping allows the gaming device 10A to establish greater awards and bonuses available to the player because of the increased number of possible combinations afforded by the virtual reel strips.

A game on a spinning reel slot machine 10A typically includes the player pressing the "bet-one" button (one of the game buttons 32A) to wager a desired number of credits followed by pulling the gaming handle 12 (FIGS. 1A, 1B) or pressing the spin button 33A to spin the reels 22A. Alternatively, the player may simply press the "max-bet" button (another one of the game buttons 32A) to both wager the maximum number of credits permitted and initiate the spinning of the reels 22A. The spinning reels 22A may all stop at the same time or may individually stop one after another (typically from left to right) to build player anticipation. Because the display 20A usually cannot be physically modified, some spinning reel slot machines 10A include an electronic display screen in the top box 18 (FIG. 1B), a mechanical bonus mechanism in the top box 18, or a secondary display 25 (FIG. 1A) to execute a bonus.

Referring to FIG. 2B, a video gaming machine 10B may include a video display 20B to display virtual spinning reels 22B and various other gaming information 21B. The video display 20B may be a CRT, LCD, plasma screen, or the like. It is usually preferable that the video display 20B be a touch-screen to accept player input. A number of symbols 23A appear on each of the virtual spinning reels 22B. Although FIG. 2B shows five virtual spinning reels 22B, the flexibility of the video display 20B allows for various reel 22B and game configurations. For example, some video slot games 10B spin reels for each individual symbol position (or stop) that appears on the video display 20B. That is, each symbol position on the screen is independent of every other position during the games. In these types of games, very large numbers of pay lines or multiple super scatter pays can be utilized since similar symbols could appear at every symbol position on the video display 20B. On the other hand, other video slot games 10B more closely resemble the mechanical spinning reel games where symbols that are vertically adjacent to each other are part of the same continuous virtual spinning reel 22B.

Because the virtual spinning reels 22B, by virtue of being computer implemented, can have almost any number of stops on a reel strip, it is much easier to have a greater variety of displayed outcomes as compared to spinning-reel slot machines 10A (FIG. 2A) that have a fixed number of physical stops on each spinning reel 22A.

With the possible increases in reel 22B numbers and configurations over the mechanical gaming device 10A, video gaming devices 10B often have multiple paylines 24 that may be played. By having more paylines 24 available to play, the player may be more likely to have a winning combination when the reels 22B stop and the game ends. However, since the player typically must wager at least a minimum number of credits to enable each payline 24 to be eligible for winning, the overall odds of winning are not much different, if at all, than if the player is wagering only on a single payline. For example, in a five line game, the player may bet one credit per payline 24 and be eligible for winning symbol combinations that appear on any of the five played paylines 24. This gives a total of five credits wagered and five possible winning paylines 24. If, on the other hand, the player only wagers one credit on one payline 24, but plays five games, the odds of winning would be identical as above: five credits wagered and five possible winning paylines 24.

Because the video display 20B can easily modify the image output by the video display 20B, bonuses, such as second screen bonuses are relatively easy to award on the video slot game 10B. That is, if a bonus is triggered during game play, the video display 20B may simply store the resulting screen shot in memory and display a bonus sequence on the video display 20B. After the bonus sequence is completed, the video display 20B may then retrieve the previous screen shot and information from memory, and re-display that image.

Also, as mentioned above, the video display 20B may allow various other game information 21B to be displayed. For example, as shown in FIG. 2B, banner information may be displayed above the spinning reels 22B to inform the player, perhaps, which symbol combination is needed to trigger a bonus. Also, instead of providing a separate credit meter 27 (FIG. 1A) and bet meter 28, the same information can instead be displayed on the video display 20B. In addition, "soft buttons" 29B such as a "spin" button or "help/see pays" button may be built using the touch screen video display 20B. Such customization and ease of changing the image shown on the display 20B adds to the flexibility of the game 10B.

Even with the improved flexibility afforded by the video display 20B, several physical buttons 32B and 33B are usually provided on video slot machines 10B. These buttons may include game buttons 32B that allow a player to choose the number of paylines 24 he or she would like to play and the number of credits wagered on each payline 24. In addition, a max bet button (one of the game buttons 32B) allows a player to place a maximum credit wager on the maximum number of available paylines 24 and initiate a game. A repeat bet or spin button 33B may also be used to initiate each game when the max bet button is not used.

Referring to FIG. 2C, a video poker gaming device 10C may include a video display 20C that is physically similar to the video display 20B shown in FIG. 2B. The video display 20C may show a poker hand of five cards 23C and various other player information 21C including a paytable for various winning hands, as well as a plurality of player selectable soft buttons 29C. The video display 20C may present a poker hand of five cards 23C and various other player information 21C including a number of player selectable soft (touch-screen) buttons 29C and a paytable for various winning hands. Although the embodiment illustrated in FIG. 3C shows only one hand of poker on the video display 20C, various other video poker machines 10C may show several poker hands (multi-hand poker). Typically, video poker machines 10C play "draw" poker in which a player is dealt a hand of five cards, has the opportunity to hold any combination of those five cards, and then draws new cards to replace the discarded ones. All pays are usually given for winning combinations resulting from the final hand, although some video poker games 10C may give bonus credits for certain combinations received on the first hand before the draw. In the example shown in FIG. 2C a player has been dealt two aces, a three, a six, and a nine. The video poker game 10C may provide a bonus or payout for the player having been dealt the pair of aces, even before the player decides what to discard in the draw. Since pairs, three of a kind, etc. are typically needed for wins, a player would likely hold the two aces that have been dealt and draw three cards to replace the three, six, and nine in the hope of receiving additional aces or other cards leading to a winning combination with a higher award amount. After the draw and revealing of the final hand, the video poker game 10C typically awards any credits won to the credit meter.

The player selectable soft buttons 29C appearing on the screen respectively correspond to each card on the video display 20C. These soft buttons 29C allow players to select specific cards on the video display 20C such that the card corresponding to the selected soft button is "held" before the draw. Typically, video poker machines 10C also include physical game buttons 32C that correspond to the cards in the hand and may be selected to hold a corresponding card. A deal/draw button 33C may also be included to initiate a game after credits have been wagered (with a bet button 32C, for example) and to draw any cards not held after the first hand is displayed.

Although examples of a spinning reel slot machine 10A, a video slot machine 10B, and a video poker machine 10C have been illustrated in FIGS. 2A-2C, gaming machines and various other types of gaming devices known in the art are contemplated and are within the scope of the invention.

Figure 3:
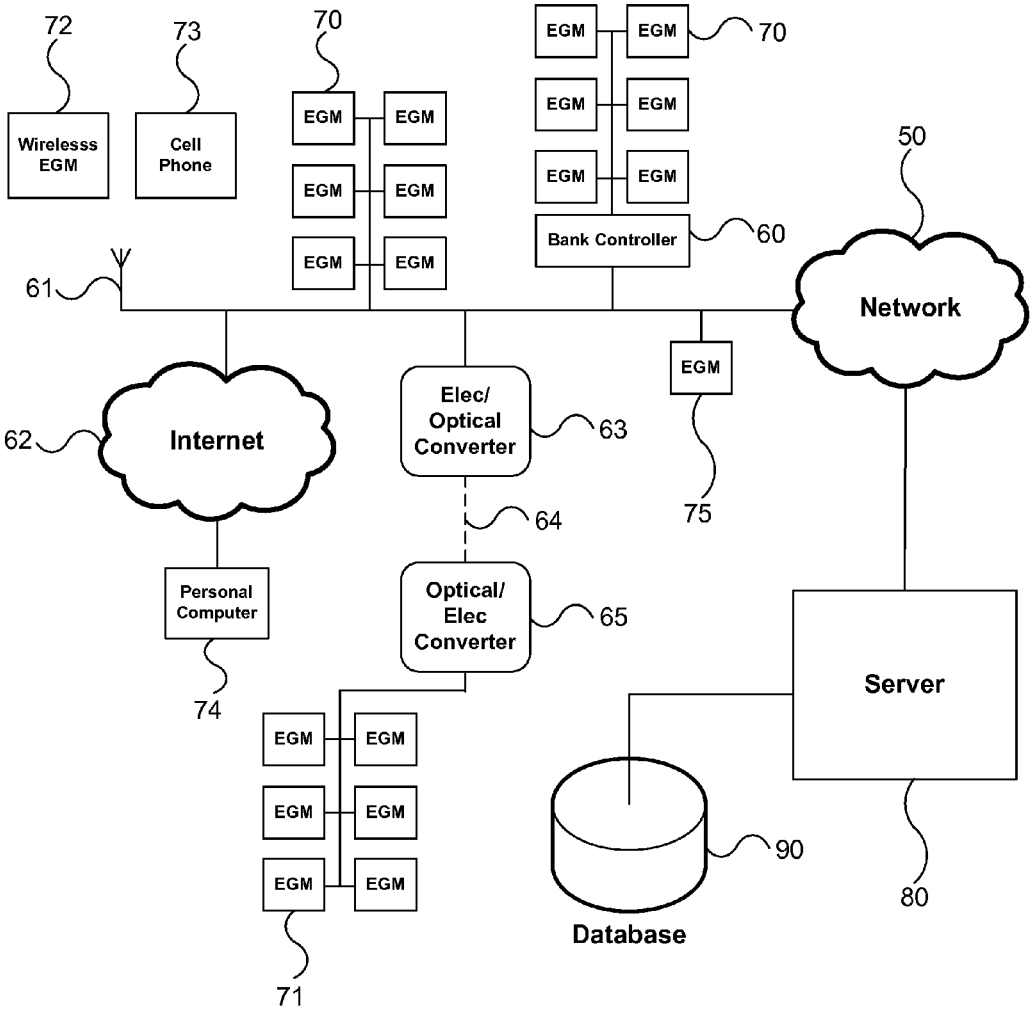
FIG. 3 is a functional block diagram of networked gaming devices according to embodiments of the invention.

FIG. 3 is a block diagram illustrating networked gaming devices according to embodiments of the invention. Referring to FIG. 3, multiple electronic gaming devices (EGMs) 70, 71, 72, 73, 74, and 75 may be coupled to one another and coupled to a remote server 80 through a network 50. For ease of understanding, gaming devices or EGMs 70, 71, 72, 73, 74, and 75 are generically referred to as EGMs 70-75. The term EGMs 70-75, however, may refer to any combination of one or more of EGMs 70, 71, 72, 73, 74, and 75. Additionally, the gaming server 80 may be coupled to one or more gaming databases 90. These gaming network 50 connections may allow multiple gaming devices 70-75 to remain in communication with one another during particular gaming modes such as tournament play or remote head-to-head play. Although some of the gaming devices 70-75 coupled on the gaming network 50 may resemble the gaming devices 10, 10A, 10B, and 10C shown in FIGS. 1A-1B and 2A-2C, other coupled gaming devices 70-75 may include differently configured gaming devices. For example, the gaming devices 70-75 may include traditional slot machines 75 directly coupled to the network 50, banks of gaming devices 70 coupled to the network 50, banks of gaming devices 70 coupled to the network through a bank controller 60, wireless handheld gaming machines 72 and cell phones 73 coupled to the gaming network 50 through one or more wireless routers or antennas 61, personal computers 74 coupled to the network 50 through the internet 62, and banks of gaming devices 71 coupled to the network through one or more optical connection lines 64. Additionally, some of the traditional gaming devices 70, 71, and 75 may include electronic gaming tables, multi-station gaming devices, or electronic components operating in conjunction with non-gaming components, such as automatic card readers, chip readers, and chip counters, for example.

Gaming devices 71 coupled over an optical line 64 may be remote gaming devices in a different location or casino. The optical line 64 may be coupled to the gaming network 50 through an electronic to optical signal converter 63 and may be coupled to the gaming devices 71 through an optical to electronic signal converter 65. The banks of gaming devices 70 coupled to the network 50 may be coupled through a bank controller 60 for compatibility purposes, for local organization and control, or for signal buffering purposes. The network 50 may include serial or parallel signal transmission lines and carry data in accordance with data transfer protocols such as Ethernet transmission lines, Rs-232 lines, firewire lines, USB lines, or other communication protocols. Although not shown in FIG. 3, substantially the entire network 50 may be made of fiber optic lines or may be a wireless network utilizing a wireless protocol such as IEEE 802.11 a, b, g, or n, Zigbee, RF protocols, optical transmission, near-field transmission, or the like.

As mentioned above, each gaming device 70-75 may have an individual processor 40 (FIG. 1A) and memory 41 to run and control game play on the gaming device 70-75, or some of the gaming devices 70-75 may be terminals that are run by a remote server 80 in a server based gaming environment. Server based gaming environments may be advantageous to casinos by allowing fast downloading of particular game types or themes based on casino preference or player selection. Additionally, tournament based games, linked games, and certain game types, such as BINGO or keno may benefit from at least some server 80 based control.

Thus, in some embodiments, the network 50, server 80, and database 90 may be dedicated to communications regarding specific game or tournament play. In other embodiments, however, the network 50, server 80, and database 90 may be part of a player tracking network. For player tracking capabilities, when a player inserts a player tracking card in the card reader 46 (FIG. 1A), the player tracking unit 45 sends player identification information obtained on the card reader 46 through the MCI 42 over the network 50 to the player tracking server 80, where the player identification information is compared to player information records in the player database 90 to provide the player with information regarding their player account or other features at the gaming device 10 where the player is wagering. Additionally, multiple databases 90 and/or servers 80 may be present and coupled to one or more networks 50 to provide a variety of gaming services, such as both game/tournament data and player tracking data.

The various systems described with reference to FIGS. 1-3 can be used in a number of ways. For instance, the systems can be used to track data about various players. The tracked data can be used by the casino to provide additional benefits to players, such as extra bonuses or extra benefits such as bonus games and other benefits as described above. These added benefits further entice the players to play at the casino that provides the benefits.

As discussed above, it is often desirable to measure the value of a new game being introduced on a gaming floor. Conventional methods of simply comparing a game's performance against a house average provides limited information about the value of a new game because, as previously pointed out, the new game may simply be diverting players away from another game they would have otherwise played. As opposed to these conventional methods, embodiments of the present concept measure and analyze the incremental revenue associated with a new game or a new gaming feature to determine the value of the new game or feature. While the below embodiments may refer to a newly implemented game or a newly implemented feature, the principles discussed could be used for either as well as for other different aspects of gaming, such as gaming floor rearrangement, attraction implementation, entertainment bookings, casino promotions, etc.

Figure 4:
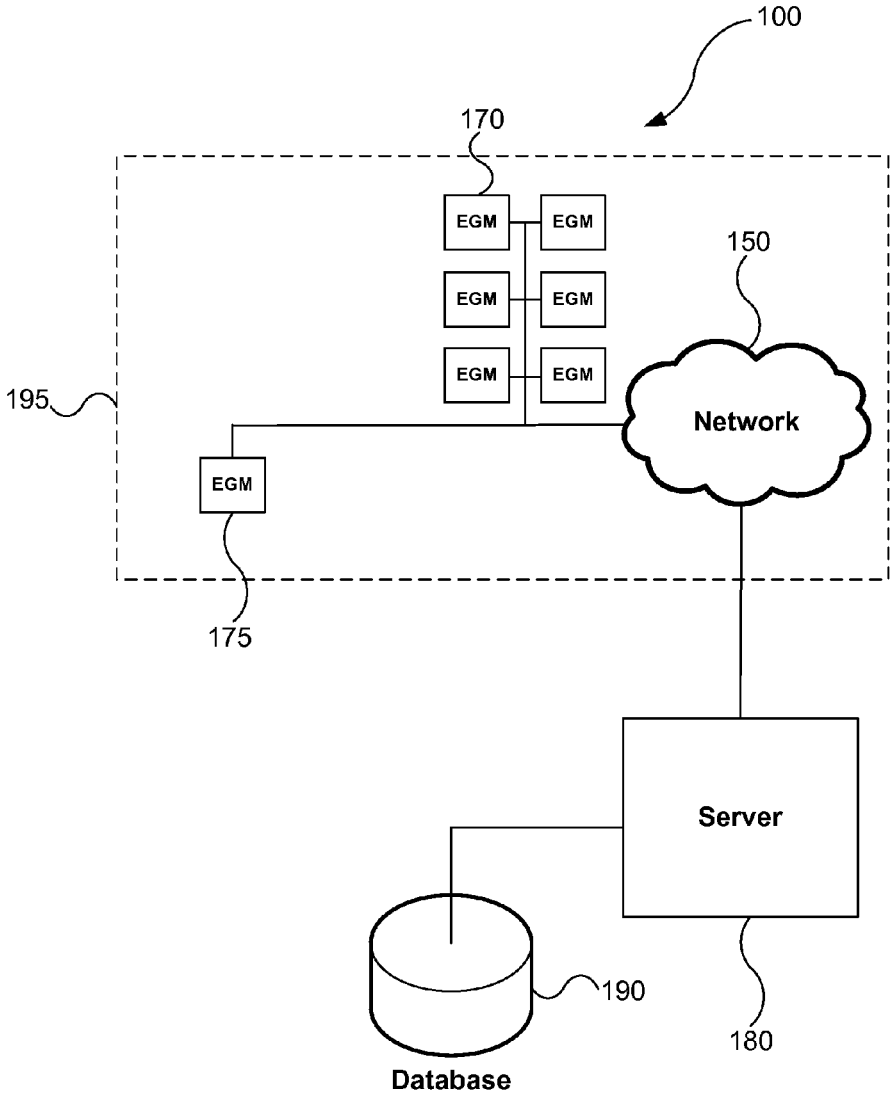
FIG. 4 is a functional block diagram of networked gaming devices according to embodiments of the invention.

FIG. 4 illustrates a functional block diagram of networked gaming devices according to embodiments of the invention.

Referring to FIG. 4, a gaming system 100 includes a plurality of existing gaming devices 170 connected to a server 180 through a game network 150. The system 100 may also include a database 190 that is connected to the server 180 or is part of the server 180. The existing gaming devices 170 may be any type of gaming device, such as the ones discussed above. Each of the existing gaming device 170 may be located in a gaming property or area 195. The gaming property 195 is essentially an area that includes multiple gaming devices and may be defined, for example, as the entire game floor of a casino, a portion of the game floor in a casino, or game floors from multiple related casinos. A new gaming device 175 is also connected to the server 180 through the game network 150 and is located as well in the gaming property 195. Although the implementation of a new gaming device 175 is discussed in this illustrated embodiment, the gaming system 100 may also be used to determine incremental revenue differences of a newly implemented feature or other gaming aspect.

Here, however, incremental revenue determination methods will be used to measure and determine the desirability and value of the newly implemented gaming device 175. In analyzing incremental revenue, a base or historical value or set of values is preferably established in a period prior to obtaining performance measurements for the new gaming device 175 so that incremental differences in revenue generated during the measurement periods can be obtained. Some of the data that can be usefully used as base values currently exists on back-end accounting databases and player account databases. Even if does not currently exist, it is generally possible to modify these existing systems to record the necessary data for use in incremental revenue comparisons. These modifications may include modifying codified instructions to record and store additional data during predetermined periods. Although actual measured values are preferably retrieved to establish revenue performance of the game property 195, it is possible to use performance estimations and other techniques to provide a base value for use in incremental revenue comparison. An exemplary method of using incremental revenue analysis is shown in FIG. 5.

Figure 5:
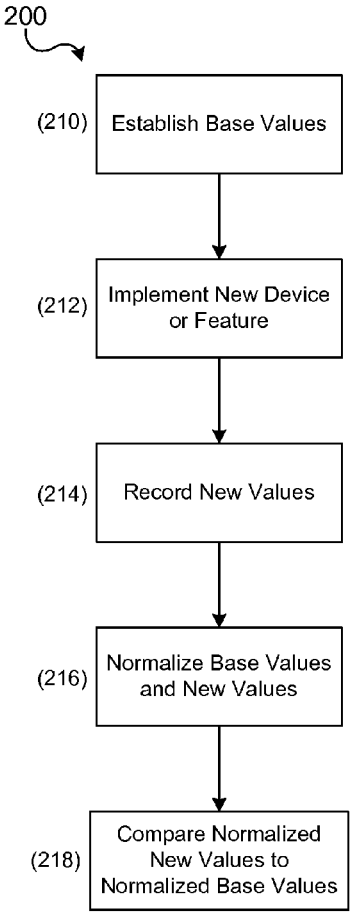
FIG. 5 is a flow diagram of a method of measuring game performance according to embodiments of the invention.

FIG. 5 is a flow diagram of a method of measuring game performance according to embodiments of the invention.

Referring to FIG. 5, a flow 200 begins by establishing base values in process (210). As discussed above, base values are needed to later compare the performance of a new gaming device or new feature. The base values may be measured and/or estimated average coin-in data for a particular player, game device, or set of gaming devices. Alternatively, the base values may include time of play data, average loss per session, average size of currency used, average win data, etc. As mentioned above, the data used for these base values is often already stored in conventional gaming systems and simply needs to be accessed and gathered. In process (212), a new gaming device or new gaming feature is implemented. A new gaming device may be a new gaming device, such as a new slot machine, video poker machine, or other electronic gaming device. The gaming device may be new in theme, style of play, feature availability, or a combination of these attributes. Alternatively, the value of a new feature may be desired. Here, the new feature may be a new promotional bonus on a single gaming device, a multi-game or bank bonus, a new available system advancement, a new player activity, or another type of gaming feature.

Once the new gaming device or feature has been implemented, new values are recorded in process (214). These new values may also include average coin-in data for a particular player, game device, or set of gaming devices, or may include time of play data, average loss per session, average size of currency used, average win data, etc. The base values and new values are normalized in process (216). Normalization may be important so that like values can be later compared. For example, if coin-in data was previously recorded and averaged over a week for a game property, but a new gaming device has only been on the game property for four days, the coin-in data for the new measurements will have to be normalized to be accurately compared to the prior weekly coin-in data. Here, the newly recorded values may have to be multiplied by a factor of 1.75 (or seven divided by four). Normalizion is rarely as simple as this as one of skill in the art understands. For example, if two of the four days were Friday and Saturday, the multiplier could be significantly less than 1.75. If one or both of the data sets are already in the desired format for comparison, the normalization step may simply be skipped or the normalization may be carried out by simply multiplying the data by 1.0, which does not effectively alter the data. The normalized new values are then compared to the normalized base values in process (218) to obtain the incremental revenue attributable to the new gaming device. For example, if the coin-in values for a particular player, a group of players, or for the game property as a whole increases, this incremental increase may be attributable to the new gaming device or new gaming feature. The normalization steps in process (216) may take into account various factors that could skew the data due to external factors not related to the new gaming device. As discussed in more detail below, a table of scaling factors may be utilized during this normalization process (216) to account for identified external factors.

FIG. 5 provides a broad overview of obtaining incremental data that may be useful in gauging the value of a new gaming device or feature. However, various types of measured data from various sources may provide different levels of accuracy and even different results. Thus, different sources of measured data will be discussed below to provide a context of how example results may vary and may be utilized.

When looking at sources of for data measurement, the easiest sources for obtaining and comparing data are player-based sources and property-based sources. One reason that these sources particularly lend themselves to analysis is because historical data is generally already stored for these sources. For example, player account databases typically store coin-in and other information about previous gaming sessions for identified players. Similarly, back-end accounting systems typically store coin-in information and other data associated with the performance of a game property. Each of these sources will be analyzed in more detail below.

Player Determination Method

One accurate source for determining incremental revenue of a new gaming device or feature is player data of the players that played the new gaming device or feature. Since there are many different types of players, from first time gamblers to regular high-rollers, the different play characteristics of these different types of players may provide additional insight to what group of players the game or feature appeals to. This information in turn may be used in marketing and promotional material so that the game device or feature is emphasized to an appropriate audience.

Figure 6:
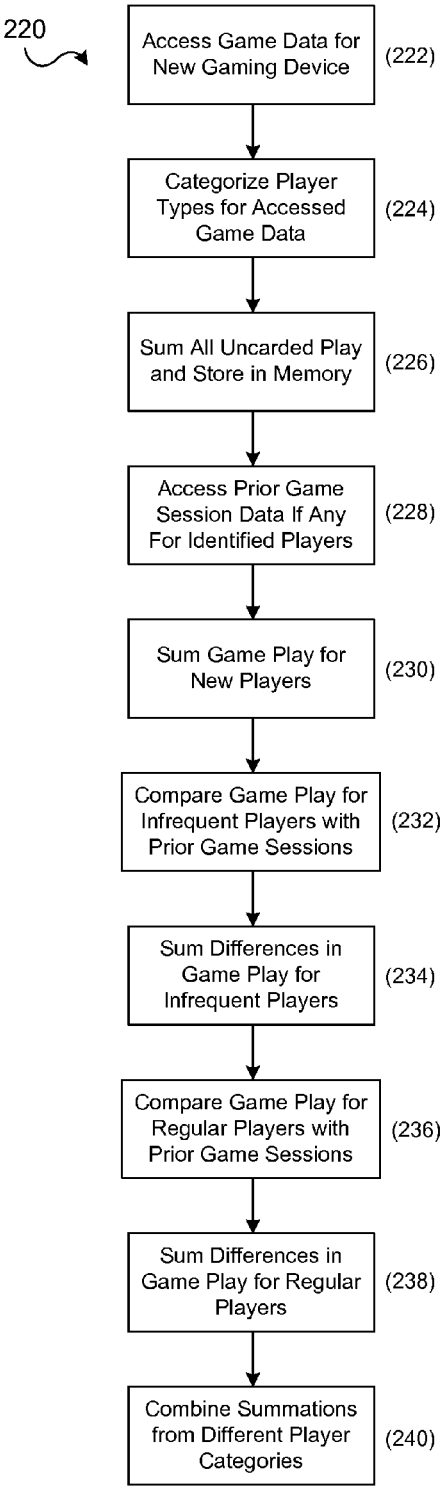
FIG. 6 is a flow diagram of a method of measuring incremental revenue associated with player statistics according to embodiments of the invention.

FIG. 6 is a flow diagram of a method of measuring incremental revenue associated with player statistics according to embodiments of the invention.

Referring to FIG. 6, a flow 220 begins by accessing game date for a new gaming device in process (222). For example, a new gaming device may be placed on June 1 and game data for the first week of its implementation may be accessed. In process (224), the accessed game data is separated by predefined categories of players. Here, any useful categorization of the players may be used. For the purpose of this embodiment, the players are categorized in one of four groupings. The first grouping is uncarded or unidentified players. This group includes all players that do not identify themselves to the new gaming device. Some of the players may have a player loyalty account and have simply forgot to enter their player card, while other players simply do not have a player account. The second group is identified players that are new players. This group includes players that do not have any prior game sessions stored on a player database. They may be players that are familiar with the casino, but have only recently signed up to have a player account, players that are new to the casino, or players that are gambling for the first time. The third group is identified players that are infrequent visitors to the casino. This group includes players that have previous game sessions stored in association with their player accounts, but the stored games sessions are few and far between. This group may include players that only visit the casino once a year or once every six months on a vacation. The fourth group is identified players that are regular gamblers. This group includes players that regularly visit the casino and have several gaming session records stored in association with their player account. The separation between infrequent and regular players may be set or modified by the casino or another entity analyzing play characteristics of the new game. In other embodiments, additional or fewer groups of players may be defined, which may depend in part on the goals of the analysis.

Although the above four categories of players has been defined for the current example, player categories may be defined or further defined based on other criteria, such as being defined based upon play patterns. For example, some players have an affinity for video slot machines, while others prefer mechanical spinning reel games. It can be important to measure how well a game performs within player categories that have already shown an affinity for that type of game. Also, many gamblers are driven by habit and play the same game over and again. It is useful to measure play of a game not only by its play from players who typically like similar game types but also to measure against players that normally don't play games of the type being measured. That's because a game that attracts even a small amount of play from players who normally patronize a different kind of machine could indicate a game that, over time, will attract play from such players.

It is important to also measure play, not just on a single snapshot, but over a period of time. For example, a game that attracts just a few players in its early weeks but steadily grows, could be a game of great value given enough time for players to become acclimated to it. Yet another important means for categorizing players is by their habits: time of day and day of week of typical play are useful differentiators, as is volume of play. Play volume can be considered from several perspectives, play in a given session at a game, play during a single visit or a time period such as a month or a year. Of course, when long-term play periods are being measured, care must be taken to ensure an appropriate testing period for the game being measured.

Play volume may be considered simply as total wagers made, or it could be considered as total loss during a period or a session. For example, a player on a winning streak might very well make more total wagers than a person whose luck is running cold. It is also useful to note how such periods of good or bad fortune affects a given player or a given player category for overall future wager activity.

It is useful to graph, the credit meter balance of each play session for each player and consolidate that information into categorization and analysis. By measuring the resulting credit meter balance after each wager, an accurate understanding of player experience is obtained. Whether the credit meter ever rises above player-funded wagers made is useful to note, as are relative rises in the credit meter balance, even if the balance never exceeds the amount of money a player has invested in the game. Graphing is often thought of only from a visual perspective. But electronic or other automated analysis of the rise and fall of credit meter balance is the most efficient means of analyzing player experience as volumes of data in a typical casino quickly becomes overwhelming when manual processes are applied.

Even uncarded players can be categorized according to play volume and play experiences. Although the identity of a given player is unknown, it is useful to subcategorize uncarded players when using their behavior in measurement and evaluation of a game's performance and incremental revenue contribution.

After the game data has been separated out by player category in process (224), the relevant uncarded/unidentified game play is summed and stored in process (226). Since the play of this group cannot be tied to a particular player or as part of a larger game session for comparison's sake, it is simply grouped together. In process (228) prior game session data (if any) is accessed for each of the identified players that played the new gaming device as part of a recent gaming session. This prior game session data may be accessed from a player account database and may include raw game session data, such as total coin-in played for a previous game session, or may include summarized or averaged game data, such as an average coin-in per game session.

In process (230), the game play for new players from their recent game session that included game play of the new game is summed Since new players by definition do not have previously stored game session for which to compare the recent game session, the game play data for the new gaming device and the total game play data may be totaled and stored. The game play data from a recent game session is compared to the accessed game session data for the infrequent players in process (232). The differences from this comparison may be summed up for all of the infrequent players and stored in process (234). Similarly, the game play data from the recent game sessions is compared to the accessed game session data for the regular players in process (236), and the differences attributable to this comparison are summed up and stored in process (238).

The stored summations for each of the player groupings is then combined and analyzed in process (240). This may include averaging each of the stored summations and/or weighting each player category summation. That is, each category of player may require a slightly different analysis to accurately reach the incremental revenue attributed to the new gaming device. For example, the uncarded play of the gaming device can only be compared against other uncarded play of similar gaming devices, such as gaming devices of a similar theme, location, and/or denomination. This comparison may provide insight to incremental revenue attributable to the new gaming device, as uncarded/unidentified players are often new. Or at least infrequent, visitors to the casino and the new game may be what attracts them. Therefore, although total revenues for the game might not seem great, especially early in the life of a new game, significant revenue from uncarded/unidentified players is a sign that a game is attracting new revenues to the casino—especially if revenue from uncared/unidentified players is growing over time, or if a disproportionate amount of play from newly card players is found on the machine being measured. That's because many of the people who initially started playing the machine without identification could choose to join the casino's loyalty program specifically because of the new game. Indeed, any indication that a game is bringing new players to the casino's loyalty club is very valuable knowledge.

For new players and infrequent players, substantially all of their game play may be attributable to the new gaming device. Here, the players may have visited the casino simply to play the gaming device or may have played longer or wagered more money due in part to the new gaming device. A portion of this analysis may also focus on the time or credits spent on the new gaming device versus other gaming devices during their gaming session. That is, if a large portion of the player's gaming session was spent at the new gaming device, it is more likely that this revenue generated by the new gaming device was incremental revenue that would have not otherwise been collected by the casino. On the other hand, if the player only played a few games of a much larger gaming session at the new gaming device, it is more likely that the player either did not like the new gaming device or would have spent the same wager on a different machine. However, the difference in these two scenarios is naturally handled by the summation and averaging of the game play data in processes (230), (234), and (240).

Regular players can also be a good group by which to measure incremental revenue associated with a new gaming device because these players have a strong track record of gaming sessions played at the casino. Hence, if they place significantly different wager amounts in a game session that includes play of the new gaming device, it is very likely that this additional revenue is due to the presence of the new gaming device. For example, if player A typically averages about $700 of wagers over four hour game sessions and then places $1000 worth of wagers in a game session including $500 in wagers on the new gaming device, it is likely that the additional $300 is due in part to the player's interest in the new gaming device. On the other hand, if player B typically wagers $800 of wagers over three hour game sessions and then places $800 of wagers in a game session that included $700 in wagers on the new gaming device, the new gaming device is simply taking player B's play away from another gaming device that she would have likely played anyway. Thus, although player B placed more wagers than player A on the new gaming device, the new gaming device did not generate any incremental revenue from player B. In contrast, player A placed an additional $300 in wagers that can be attributed in part to the play on the new gaming device.

In combining the stored data from the different player categories in process (240), different weights may be assigned to each of the player categories. For example, if a casino was really interested in seeing how established players were receiving a new game, a greater weight may be placed on the data from regular players, followed by less weight placed on the data from new and infrequent players, and followed by relatively little weight being placed on the uncarded play data. Alternatively, only one or some of the player categories may be used to determine incremental revenue generation by the new gaming device. These relative weightings are mentioned only for illustration and actual weighting in a given measurement may be quite different.

As mentioned above, the categorization of game data among groups of players may identify types of players that the new gaming device may appeal to. For example, if the game play for new players and infrequent players is relatively high on the new gaming device, the new gaming device may appeal to newer gamblers. The casino may utilize this information to market the new gaming device as beginner friendly and/or lower the denomination required to play the game since newer player are not as likely to play higher denomination gaming devices. Additionally, if certain trends appear in the analyzed game sessions, such as players typically playing another gaming device along with the new gaming device, the inference may be made that players that like the other gaming device would like the new gaming device as well. This information could be used by suggesting to players of the other gaming device that they would likely enjoy the new gaming device as well. Promotional credits may even be offered to players at the other gaming device to try the new gaming device.

Property Determination Method

The property determination method is another incremental revenue tool that can be used to determine the value of new gaming device or feature. Unlike the player determination method discussed above, the property determination method focuses on the revenue generated for a particular gaming area rather than relying on measurements taken for individual or groups of players. Here, the incremental differences in the revenue generated for the gaming area may compared for time periods prior to the installation of the new game or feature with time periods following the installation of the new game or feature. Although normal fluctuations in business may have an influence on the revenue generated during either of these time periods, this effect can be minimized by using scaling factors to modify the measured values.

Figure 7:
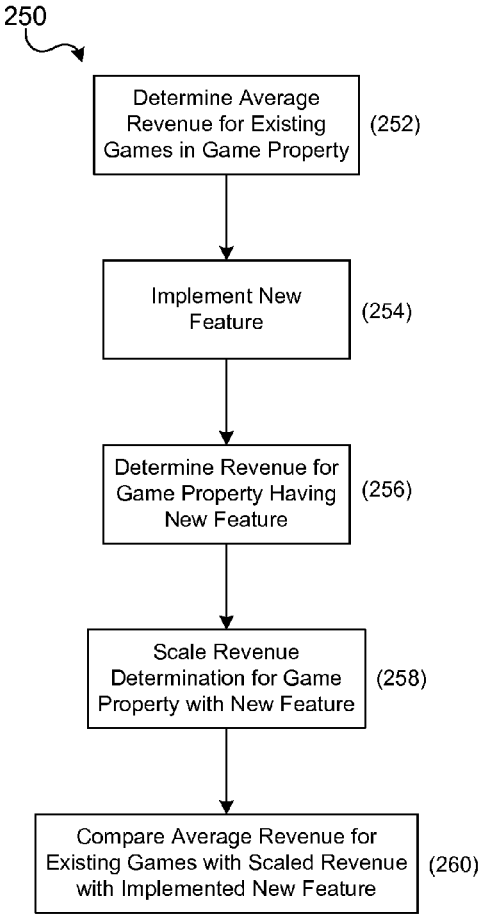
FIG. 7 is a flow diagram of a method of measuring incremental revenue associated with property statistics according to embodiments of the invention.

FIG. 7 is a flow diagram of a method of measuring incremental revenue associated with property statistics according to embodiments of the invention.

Referring to FIG. 7, flow 250 measures the incremental revenue associated with a new feature added to a group of existing gaming devices. For example, this new feature may be a lucky coin mystery jackpot associated with a bank of gaming devices. Flow 250 begins by determining an average revenue for existing games in a game property in process (252). Process (252) would not necessarily be limited to determining the average revenue for the games at the gaming bank associated with the new feature since players may simply move from another bank of games to the bank associated with the new feature without wagering any additional credits over what they would have wagered at the prior game bank.

The new feature is implemented with the bank of gaming devices in process (254). In process (256) the revenue is determined for the game property with the new feature activated. This determined revenue is scaled in process (258) using one or more scaling factors. Scaling factors are used to make a later revenue comparison accurate. They are discussed in additional detail below along with examples. The scaled revenue determined for the game property with the new feature activated is then compared to the average revenue for the game property prior to the activation of the new feature in process (260). This comparison may highlight differences in the revenue generated for the game property with the implementation of the new feature. Here, these differences may be at least in part attributed to the new feature, although some natural variation in the level of business may be partially responsible for the differences. As mentioned above, the more detailed and accurate the scaling factors are, the more accurate the incremental revenue analysis may be. Additionally, longer measurement periods for the new feature will generally de-emphasize the day to day fluctuations of the business. In some instances, data from other portions of the game floor or from nearby casinos may be taken into account to ascertain any trends in the day to day business fluctuations occurring during the measurement period. These trends may also be used as scaling factors for the measured revenue with the new feature to make the comparison of process 260 more accurate.

Combination Determination Method

The combination determination method basically utilizes a variety of determination methods to get a better idea of the true value of a new gaming device or feature. Here, incremental revenue analysis may be obtained using the player and property determination methods while comparisons to house average and player surveys may be used to determine the game's popularity or desirability.

Figure 8:
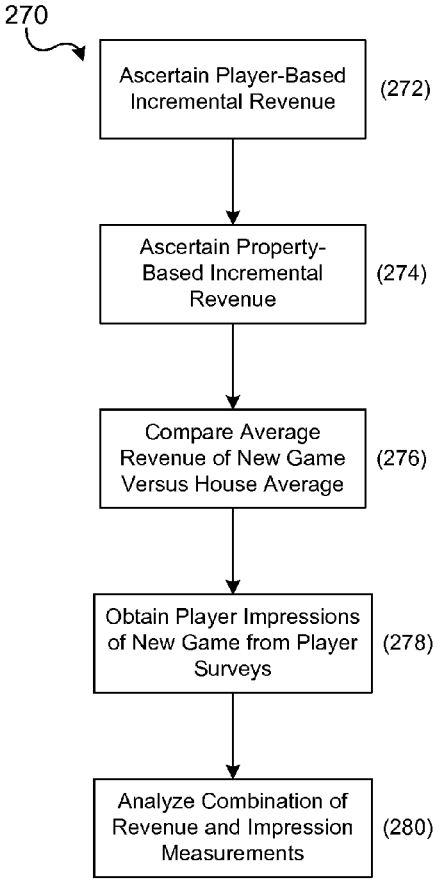
FIG. 8 is a flow diagram of a method of measuring incremental revenue associated with combination of statistics according to embodiments of the invention.

FIG. 8 is a flow diagram of a method of measuring incremental revenue associated with combination of statistics according to embodiments of the invention.

Referring to FIG. 8, flow 270 begins by ascertaining incremental revenue attributed to a new gaming device using the player determination method in process (272). In process (274), the property determination method is used to ascertain additional incremental revenue information attributed to the new gaming device. The play volume of the new gaming device is compared to the house average in process (276), and player impressions of the gaming device are ascertained in process (278) from player surveys. The player surveys may be carried out by casino personnel who observe a player at the new gaming device or may be requested by the gaming device at the end of a game session, such as when the player cashes out. Incentives such as additional cash-less credits may be offered to the player to persuade them to participate in the game survey. In process (280) the information from the above processes may be combined to provide an indication of the value of the new gaming device. Each portion of ascertained information may be included in a value report for the new gaming device. Alternatively, portions of the measured data may be combined and summarized. For example, the incremental game revenue data from the player determination method and the property determination method may be combined with each other.

Scaling Factors

As discussed above, scaling factors may be used in a variety of circumstances to provide a more accurate comparison between measured sets of data. Scaling factors may be set up for a variety of situations and circumstances and may be used with one or both of previously stored game play information and recently measured game player information. Scaling factors that are used may be automatically set according to predefined parameters or can be manually entered into a table to take into account factors that may skew the revenue data one way or the other. Table A provides an example scaling factor list with the actual scaling factor value to be determined (TBD) by a casino operator or another individual that is responsible for overseeing the analysis of the game revenue within a casino.

TABLE A

| Item | Category | Description | Scaling Factor |
|---|---|---|---|
| 1 | Player | Identified Player | TBD |
| 2 | Player | Uncarded Player | TBD |
| 3 | Time | Friday | TBD |
| 4 | Time | Saturday | TBD |
| 5 | Time | Sunday | TBD |
| 6 | Time | Other Week Day | TBD |
| 7 | Other | Game Location | TBD |
| 8 | Other | Ads/Media Attention | TBD |
| 9 | Other | Holidays | TBD |
| 10 | Other | Conventions | TBD |
| 11 | Other | Season/Weather/Environmental Influences | TBD |
| 12 | Other | General State of Economy | TBD |

Scaling factors 1 and 2 relate to the player determination method and may be used in part to alter the weight assigned to each of the identified categories of players. Here, only identified players and uncarded players are listed. However, various other entries of player types may be present if additional categories of players are separated and analyzed. Scaling factors 3, 4, 5, and 6 relate to time based measurements. These scaling factors may take into account specific time periods of revenue. For example, if revenue is only measured on a Saturday, this measurement may be artificially inflated because gaming business is generally stronger on weekends. Thus, a scaling factor to reduce this influence may be used so that this measured revenue number can be properly compared with a historical average revenue value. Scaling factor 7 relates to a game or features relative game floor position. Although game floor position may not have an overly large effect on the game play and revenue generation of a gaming device, especially good locations, such as near an entrance door, and especially bad locations, such as underneath a staircase can be accounted for.

Scaling factor 8 relates to the amount of advertisement or promotion a casino or manufacturer have put into a gaming device or feature. For example, if a relatively large amount of money has been spent on billboard space, mailers, or television ads promoting a new feature, this feature may generate more play or revenue than a feature that has had no promotion. Scaling factor 9 takes into account holidays that fall in a measurement time period. Since holidays typically increase gambling numbers, a scaling factor may be used to account for this increase. Similarly, scaling factor 10 may take into account increased game play due to a large convention that is being held at the casino or in the town where the casino is located. Scaling factor 11 may take into account a particular season and/or climate conditions during a measurement period. For example, if a Minnesota casino was implementing a new game in January and a large snow storm closed a major highway near the casino, it would likely have a strong negative impact on the revenue numbers for the game floor with the new game. Likewise, gaming numbers typically slightly down in July and August for Las Vegas because the very high temperatures do not appeal to some tourists. Scaling factor 12 may take into account the general state of the economy. For example, if historical average revenue numbers or game sessions were recorded at a time that the economy was stronger, it may be proper to increase recently measured numbers that were taken when the economy was down. Table B provides a first example of how these scaling factor numbers may be set.

TABLE B

Game: Lucky Lightening
Test Dates: Jun. 01, 2009-Jun. 28, 2009

| Item | Category | Description | Scaling Factor |
|---|---|---|---|
| 1 | Player | Identified Player | 1.2 |
| 2 | Player | Uncarded Player | 0.8 |
| 3 | Time | Friday | 1.0 |
| 4 | Time | Saturday | 1.0 |
| 5 | Time | Sunday | 1.0 |
| 6 | Time | Other Week Day | 1.0 |
| 7 | Other | Game Location | 0.95 |
| 8 | Other | Ads/Media Attention | 0.85 |
| 9 | Other | Holidays | 1.0 |
| 10 | Other | Conventions | 1.2 |
| 11 | Other | Season/Weather/Environmental Influences | 1.05 |
| 12 | Other | General State of Economy | 1.4 |

Here, a new game called Lucky Lightening has been implemented on the test floor and game player measurements have taken place between Jun. 1, 2009 and Jun. 28, 2009 (four weeks). Note that since no additional weekends or major holidays were part of this test period, these scaling factors were maintained at 1.0 so that they do not affect the measured data. Here, it also seems that a minor convention may have been in town, the weather/environment was slightly worse than average, the game had a slightly better than average placement, and the game received more promotion than normal. Table C provides another example for the sake of comparison.

TABLE C

Game: Big Bacon Bites
Test Dates: Jul. 03, 2009-Jul. 17, 2009

| Item | Category | Description | Scaling Factor |
|---|---|---|---|
| 1 | Player | Identified Player | 1.2 |
| 2 | Player | Uncarded Player | 0.8 |
| 3 | Time | Friday | 0.92 |
| 4 | Time | Saturday | 1.0 |
| 5 | Time | Sunday | 1.0 |
| 6 | Time | Other Week Day | 1.0 |
| 7 | Other | Game Location | 0.95 |
| 8 | Other | Ads/Media Attention | 1.3 |
| 9 | Other | Holidays | 0.78 |
| 10 | Other | Conventions | 1.0 |
| 11 | Other | Season/Weather/Environmental Influences | 1.15 |
| 12 | Other | General State of Economy | 1.4 |

In Table C, a new game called Big Bacon Bites has been implemented on the game floor and has a current testing range of Jul. 3, 2009 to Jul. 17, 2009. Notice that there is one extra Friday in this measurement time period which drops the Friday scaling factor down to 0.92. Additionally, since the July $4^{th}$ holiday is included in this measurement, the holiday scaling factor is also reduced. The weather/season is a little bit warmer than normal, but this game has not received much of any promotion or advertisement. Although the above examples provide some types of scaling factors, more or less factors may be used, of the factors may be used in a slightly different manner.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A method of measuring performance of a previously-unimplemented gaming feature in a game property having a plurality of existing electronic gaming devices that when played generate game outcomes, some of which result in an award, the electronic gaming devices being on a network, the method comprising:

providing game play credits to players of the gaming devices in response to receipt of value from the player via at least one of a currency acceptor, a ticket acceptor, and a coin acceptor;

receiving at least some of the game play credits as wagers via the existing gaming devices from players playing games on the gaming devices responsive to actuation of a wager input device by the player, the wager input device being associated with each electronic gaming device;

tracking wagers received on at least some of the existing gaming devices via a meter associated with each of the gaming devices on which wagers are tracked;

storing the meter data in a memory associated with each of the at least some of the existing gaming devices on which wagers are tracked;

communicating the meter data via the network from each of the gaming devices on which wagers are tracked to a database that is operatively connected to the network;

accessing the database via a computing processor;

determining an average revenue for the at least some of the existing gaming devices in a game property based on the meter data in the database using the computing processor;

implementing the previously-unimplemented feature, the previously-unimplemented feature being a mystery jackpot associated with the at least some of the existing gaming devices;

thereafter continuing to track, store, and communicate the meter data to the database;

again accessing the database via the computing processor;

determining revenue for the at least some of the existing gaming devices after the previously-unimplemented feature is implemented based on the meter data in the database using the computing processor;

determining at least one scaling factor applicable to the determined revenue;

scaling the determined revenue of the game property with the implemented previously-unimplemented feature using the determined scaling factor; and comparing the determined average revenue for the game property with the determined revenue for the game property with the implemented previously-unimplemented feature; and marketing the previously unimplemented feature based on the comparison.

2. The method of claim 1, wherein the game property is a game floor of a casino.

3. The method of claim 1, wherein the scaling factor includes a numerical multiplier associated with at least one of a holiday occurrence, a convention occurrence, a time of year, an identification determination of a player, a location of the implemented feature, a day of the week, a state of the economy, or an amount of promotion given to the feature.

4. The method of claim 1, wherein determining an average revenue for the at least some of the existing gaming devices in a game property includes:

obtaining coin-in data via the network for the at least some of the existing gaming devices over a predetermined period; and averaging the obtained coin-in data for the at least some of the existing gaming devices.

5. A method of measuring performance of a new gaming device added to a network of electronic gaming devices that when played generate game outcomes, some of which result in an award, the method comprising:

providing game play credits to players of the gaming devices in response to receipt of value from the player via at least one of a currency acceptor, a ticket acceptor, and a coin acceptor;

receiving at least some of the game play credits as wagers via the gaming devices from players playing games on the gaming devices responsive to actuation of a wager input device by the player, the wager input device being associated with each electronic gaming device;

tracking wagers received on at least some of the gaming devices via a meter associated with each of the gaming devices on which wagers are tracked;

storing the meter data in a memory associated with each of the at least some of the gaming devices on which wagers are tracked;

communicating the meter data via the network from each of the at least some of the gaming devices on which wagers are tracked to a database;

accessing the database via a computing processor;

determining an average revenue for the at least some of the gaming devices on the network based on the meter data in the database using the computer processor;

adding at least one new gaming device to the network;

determining revenue for the at least some of the at least some of the gaming devices and the at least one new gaming device after the previously-unimplemented feature is implemented based on the meter data in the database using the processor;

storing in the database the determined revenue after the at least one new gaming device is added using the processor;

determining at least one scaling factor applicable to the determined revenue;

scaling, via a computing device, the determined revenue after the at least one new gaming device is added using the determined scaling factor;

comparing, via the computing device, the determined average revenue for the at least some of the gaming devices on the network with the determined revenue after the at least one new gaming device is added; and marketing the previously unimplemented feature based on the comparison.

6. The method of claim 5, wherein the network of gaming devices is located at a game floor of a casino.

7. The method of claim 5, wherein the scaling factor includes a numerical multiplier associated with at least one of a holiday occurrence, a convention occurrence, a time of year, an identification determination of a player, a location of the implemented feature, a day of the week, a state of the economy, or an amount of promotion given to the feature.

8. The method of claim 5, wherein determining an average revenue for the at least some of the gaming devices on which wagers are tracked includes:

obtaining coin-in data via the network for the at least some of the gaming devices over a predetermined period; and averaging the obtained coin-in data for the at least some of the gaming devices.

9. A method of measuring performance of a new gaming feature associated with at least a portion of gaming devices that when played generate game outcomes, some of which result in an award, the electronic gaming devices being on a network at of gaming devices, the method comprising:

providing game play credits to players of the gaming devices in response to receipt of value from the player via at least one of a currency acceptor, a ticket acceptor, and a coin acceptor;

receiving at least some of the game play credits as wagers via the gaming devices from players playing games on the gaming devices responsive to actuation of a wager input device by the player, the wager input device being associated with each electronic gaming device;

tracking coin-in data received on at least some of the gaming devices via a meter associated with each of the gaming devices on which wagers are tracked;

storing the coin-in data in a memory associated with each of the at least some of the gaming devices on which wagers are tracked;

communicating the coin-in data via the network from each of the at least some of the gaming devices on which wagers are tracked to a database;

accessing the database via a computer processor;

averaging the obtained coin-in data for the at least some of the gaming devices on the network prior to adding the new feature;

storing the average coin-in data in a computer memory connected to the network;

adding the new feature, the new feature being a mystery jackpot associated with a least a portion of the gaming devices on the network;

determining coin-in data from the network for the gaming devices after adding the new feature;

storing in the database the determined revenue for the location after adding the new feature;

determining a scaling factor;

scaling, via a computing device, the determined revenue for the location after adding the new feature using the determined scaling factor;

comparing, via the computing device, the stored average coin-in data with the stored determined revenue after adding the new feature; and marketing the previously unimplemented feature based on the comparison.

10. The method of claim 9, wherein the network of gaming devices is located at a game floor of a casino.

11. The method of claim 9, wherein the scaling factor includes a numerical multiplier associated with at least one of a holiday occurrence, a convention occurrence, a time of year, an identification determination of a player, a location of the implemented feature, a day of the week, a state of the economy, or an amount of promotion given to the feature.

* * * * *